US007607927B2

(12) United States Patent
Kim

(10) Patent No.: US 7,607,927 B2
(45) Date of Patent: Oct. 27, 2009

(54) WATERPROOF CONNECTOR

(75) Inventor: Mun Jong Kim, Yongin-Si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/082,350

(22) Filed: Apr. 9, 2008

(65) Prior Publication Data

US 2009/0098771 A1 Apr. 16, 2009

(30) Foreign Application Priority Data

Oct. 10, 2007 (KR) ..... 10-2007-0102187

(51) Int. Cl.
*H01R 4/60* (2006.01)

(52) U.S. Cl. ..... 439/206

(58) Field of Classification Search ..... 439/205, 439/206, 271, 272, 274, 275, 357, 358, 589, 439/587

See application file for complete search history.

(56) References Cited

U.S. PATENT DOCUMENTS 5,336,102 A * 8/1994 Cairns et al. ..... 439/272
5,356,304 A * 10/1994 Colleran ..... 439/205
5,511,987 A * 4/1996 Shinchi ..... 439/205

FOREIGN PATENT DOCUMENTS

KR 1020070042808 4/2007

* cited by examiner

*Primary Examiner*—Edwin A. Leon
(74) *Attorney, Agent, or Firm*—Edwards Angell Palmer & Dodge LLP; Peter F. Corless

(57) ABSTRACT

A waterproof connector includes: a female connector member including a plurality of female terminals formed therein; a male connector member including a plurality of male terminals formed therein to correspond to respective female terminals of the female connector member; and an air discharge part having a structure in which an air passage hole for discharging inside air to the outside when the female and male connector members are assembled to each other and a slider for closing the air passage hole after air is discharged are formed in the male connector member.

6 Claims, 6 Drawing Sheets

WATERPROOF CONNECTOR

CROSS-REFERENCE TO RELATED APPLICATIONS

This application claims priority to Korean Application No. 10-2007-0102187, filed on Oct. 10, 2007, the entire disclosure of which is incorporated herein by reference.

BACKGROUND

1. Technical Field

The present invention relates to a waterproof connector for a vehicle which has improved assemblability and hermeticity.

2. Background Art

In a vehicle, connectors are used to connect wires as electric lines. The connectors for a vehicle are divided into non-waterproof connectors which are mainly used in the passenger compartment and waterproof connectors which are used in the engine compartment. The non-waterproof connectors are manufactured without considering leakage of water from outside while the waterproof connectors must have waterproof seals applied thereto to prevent the water leakage.

That is to say, the non-waterproof connectors are used in the passenger compartment where it is not necessary to worry about the water leakage, and the waterproof connectors are used in the engine compartment where the water leakage is likely to occur. Therefore, various units disposed in the engine compartment must use the waterproof connectors for preventing the water leakage.

Referring to FIG. 1, a conventional waterproof connector 100 has a female connector member 110 and a male connector member 120 which are coupled to each other so as to electrically connect the female terminals 112 of the female connector 110 and the male terminals 122 of the male connector 120 with each other. Wires 114 and 124 are connected to the female terminals 112 and the male terminals 122, respectively.

However, in the conventional waterproof connector 100, due to the presence of a waterproof seal 130 provided therein to prevent the leakage of water, when coupling the female and male connector members 110 and 120 to each other, it is not easy to fit the male connector member 120 into the female connector member 110; substantial force is required. That is to say, in the conventional waterproof connector 100, when coupling the female and male connector members 110 and 120 to each other, air in the waterproof connector 100 cannot be easily discharged due to the presence of the waterproof seal 130. Consequently, since air in the waterproof connector 100 is compressed, substantial force is required to couple the female and male connector members 110 and 120 to each other, decreasing the productivity in the assembly of the waterproof connector.

The information disclosed in this Background section is only for enhancement of understanding of the background of the invention and should not be taken as an acknowledgement or any form of suggestion that this information forms the prior art that is already known to a person skilled in the art.

SUMMARY OF THE DISCLOSURE

Accordingly, the present invention has been made keeping in mind the above problems occurring in the prior art, and an object of the present invention is to provide a waterproof connector which can couple female and male connector members to each other with a reduced force, so that the productivity in the assembly of the waterproof connector can be improved.

Another object of the present invention is to provide a waterproof connector which can discharge air therein when the female and male connector members are coupled to each other and hermetically seal the female and male connector members from the outside after the members are coupled to each other.

In order to achieve the above objects, according to one aspect of the present invention, there is provided a waterproof connector comprising: a female connector member including a plurality of female terminals formed therein; a male connector member including a plurality of male terminals formed therein to correspond to respective female terminals of the female connector member; and an air discharge part with a structure in which an air passage hole for discharging inside air to the outside when the female and male connector members are assembled to each other and a slider for closing the air passage hole after air is discharged are formed in the male connector member. The waterproof connector is structured to discharge inside air to the outside when the female and male connector members are coupled to each other to thereby decrease the force required to couple the female and male connector members to each other.

According to another aspect of the present invention, in the air discharge part, a push bar is formed above the female terminals of the female connector member to push the slider when the female and male connector members are coupled to each other, and a slide guide is formed above the male terminals of the male connector member to allow the slider to be moved rearward thereon.

According to another aspect of the present invention, the air passage hole is defined through the rear end of the slide guide, and as the slider is moved rearward from the state in which it is positioned at the front portion of the slide guide, the slider closes the air passage hole.

According to another aspect of the present invention, the slider is provided with slide projections formed on both side surfaces thereof, the male connector member is provided with slide grooves, and the slide projections are fitted into the slide grooves so that the slider can be linearly moved therein.

According to another aspect of the present invention, the slide guide is provided, on a front end thereof, with stoppers for preventing the slider from being released to the outside.

According to still another aspect of the present invention, the female connector member includes a primary waterproof seal which is squeezed between the slide guide and a lower end portion of the male connector member when the female and male connector members are coupled to each other so as to prevent the leakage of moisture from the outside.

According to a still further aspect of the present invention, the female connector member further includes a secondary waterproof seal which is squeezed by an edge of an upper end portion of the male connector member when the female and male connector members are coupled to each other so as to prevent the leakage of moisture from the outside.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like.

Other features of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration, and thus are not limitative of the present invention, and wherein:

FIGS. 3A and 3B illustrate a waterproof connector in accordance with an embodiment of the present invention, wherein FIG. 3A is an exploded cross-sectional view thereof and FIG. 3B is an assembled cross-sectional view;

FIGS. 4A through 4C illustrate the female connector member of the waterproof connector according to an embodiment of the present invention, wherein FIG. 4A is a perspective view thereof, FIG. 4B is a perspective view from a different angle, and FIG. 4C is a cross-sectional view taken along the line B-B' of FIG. 4A;

FIGS. 5A through 5C illustrate the male connector member of the waterproof connector according to an embodiment of the present invention, wherein FIG. 5A is a perspective view thereof, FIG. 5B is an enlarged view of a slider part, and FIG. 5C is a cross-sectional view taken along the line C-C' of FIG. 5A.

Figure 1:
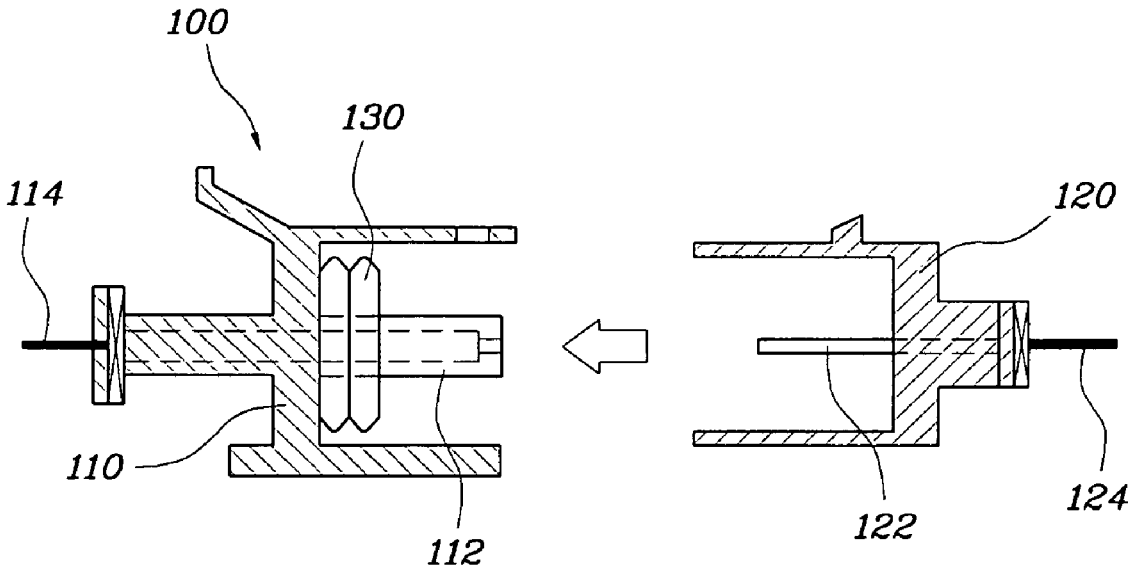
FIG. 1 is an exploded cross-sectional view illustrating a conventional waterproof connector.
Figure 2:
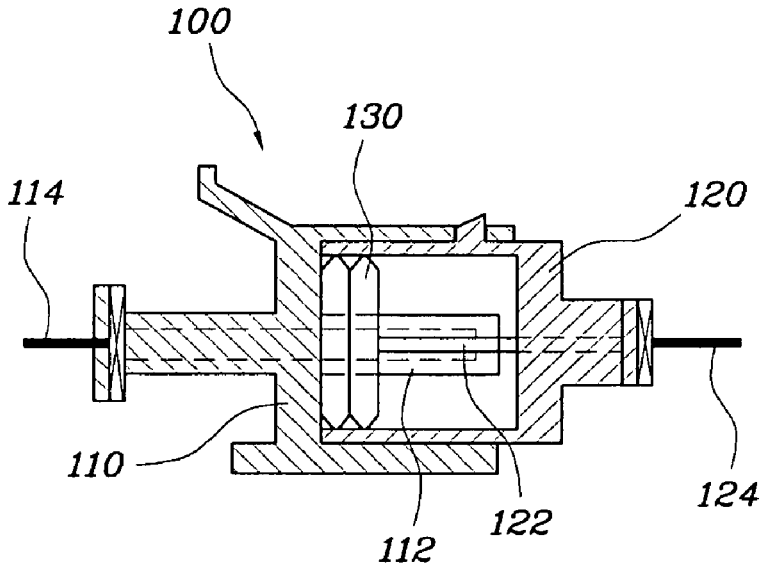
FIG. 2 is an assembled cross-sectional view illustrating the conventional waterproof connector.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to a preferred embodiment of the present invention, an example of which is illustrated in the accompanying drawings and described below. While the invention will be described in conjunction with an exemplary embodiment, it should be understood that the description is not intended to limit the invention to the exemplary embodiment. On the contrary, the invention is intended to cover not only the exemplary embodiment, but also various alternatives, modifications, equivalents and other embodiments, which may be included within the spirit and scope of the invention as defined by the appended claims.

Figure 3A:
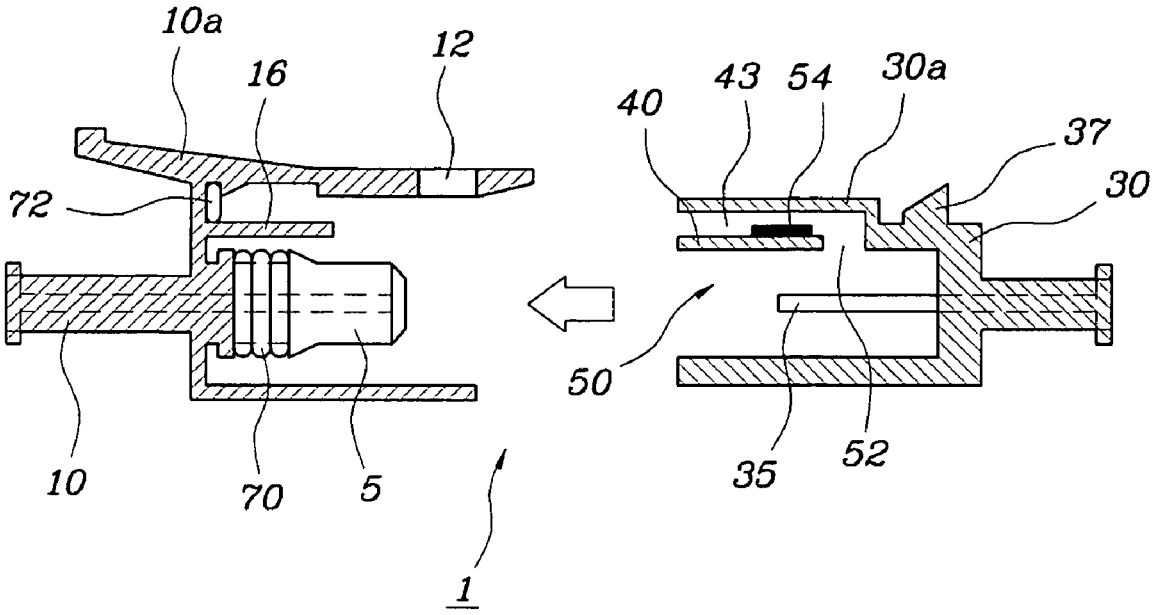
Figure 3B:
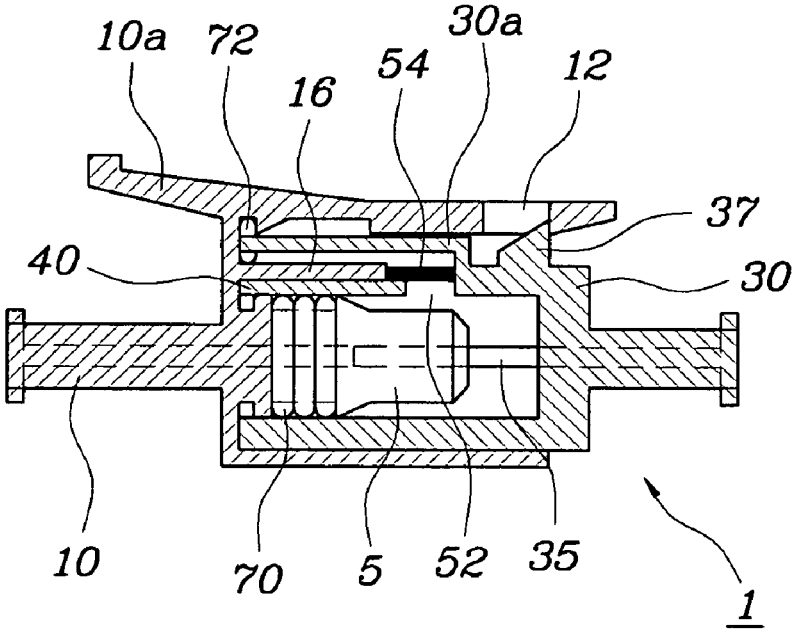

Referring to FIGS. 3A and 3B, a waterproof connector 1 in accordance with an embodiment of the present invention includes a female connector member 10 and a male connector member 30. The female connector member 10 includes a plurality of female terminals 5 formed therein. The male connector member 30 includes a plurality of male terminals 35 formed therein to correspond to respective female terminals 5 of the female connector member 10.

The female connector member 10 has a coupling hole 12 defined adjacent to one end of the upper end portion 10*a* thereof. The male connector member 30 has a coupling projection 37 formed adjacent to an end of the upper end portion 30*a* thereof. The coupling projection 37 can be fitted into the coupling hole 12. Thus, when the female and male connector members 10 and 30 are coupled to each other, they can be securely held to each other.

The waterproof connector 1 further includes an air discharge part 50 which discharges air present in the female and male connector members 10 and 30 when they are coupled to each other, which enables the female and male connector members to be coupled with a reduced force.

The air discharge part 50 has a structure in which an air passage hole 52 for discharging the inside air to the outside when the female connector member 10 is assembled to the male connector member 30 and a slider 54 for closing the air passage hole 52 after air is discharged are formed in the male connector member 30.

Figure 4A:
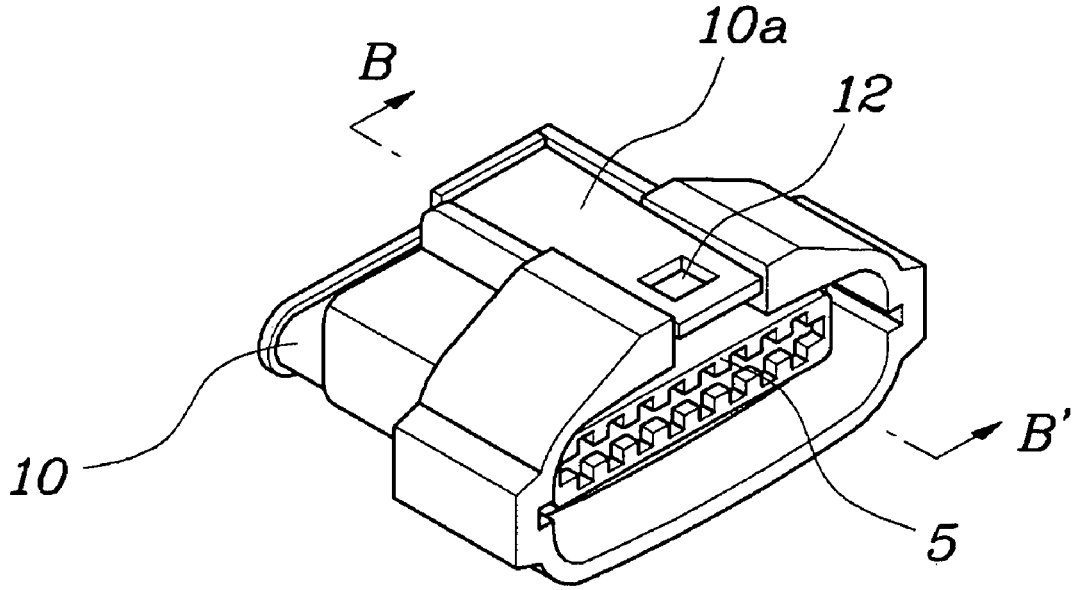
Figure 4B:
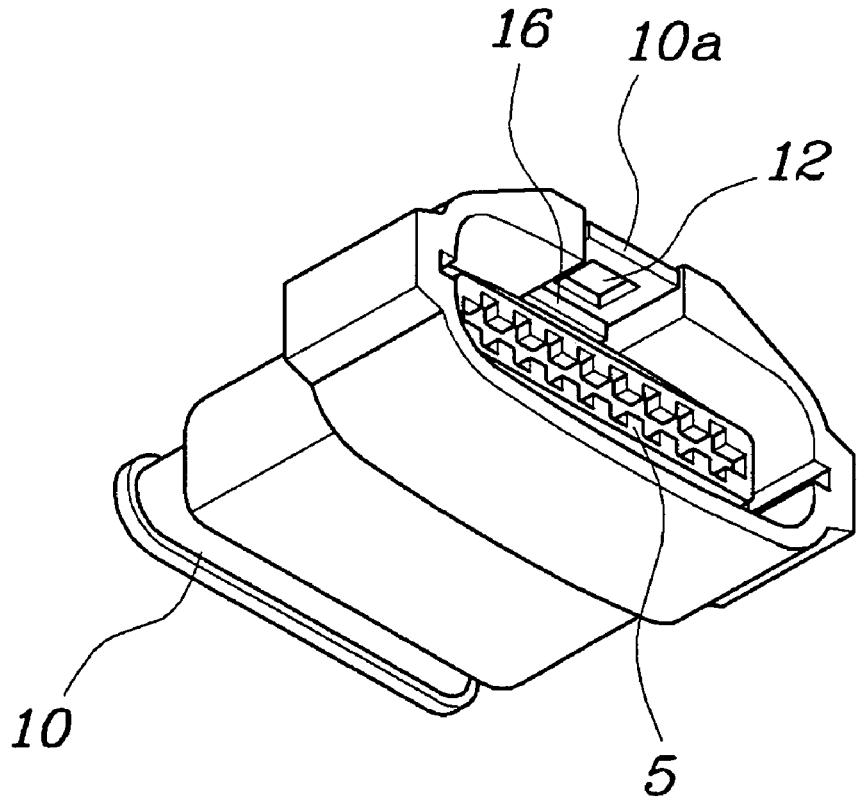
Figure 4C:
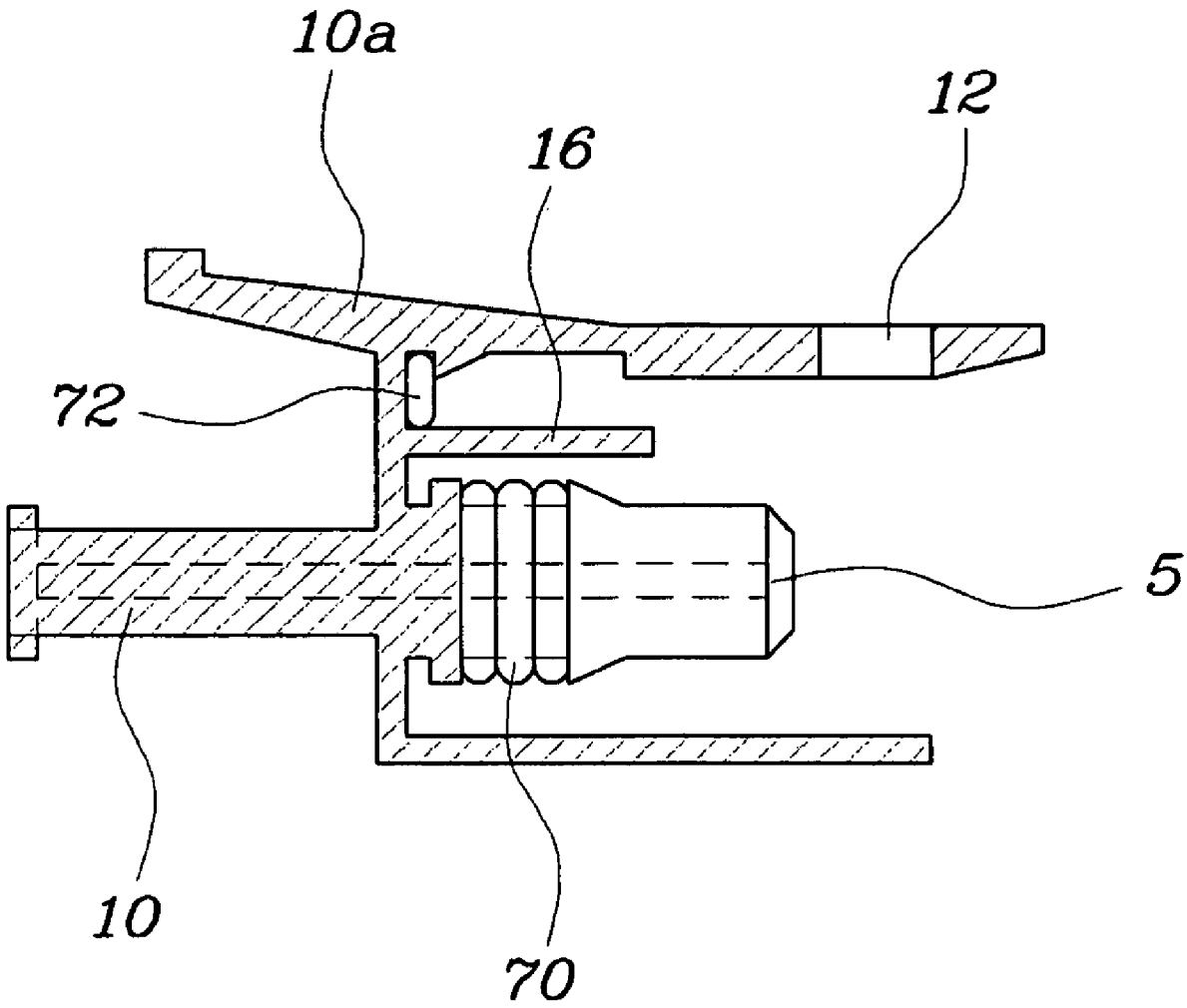
Figure 5A:
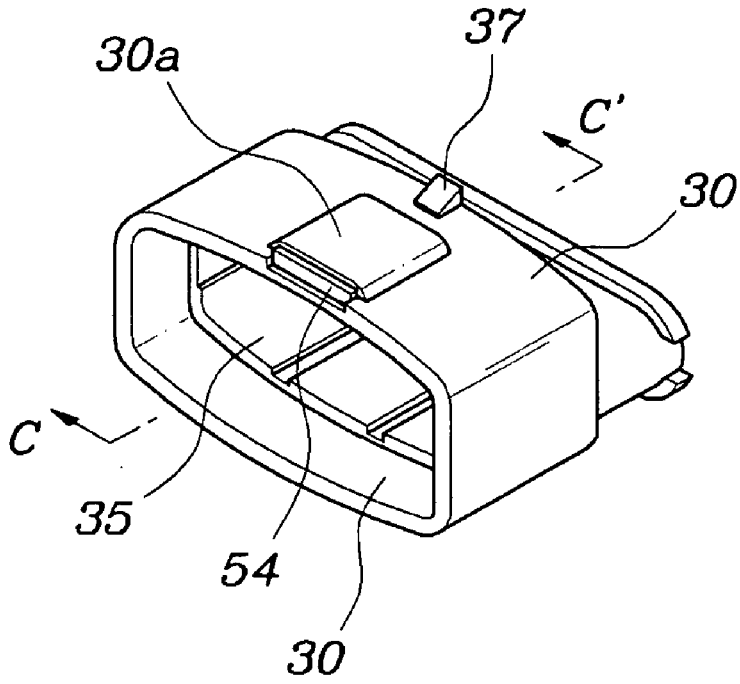
Figure 5B:
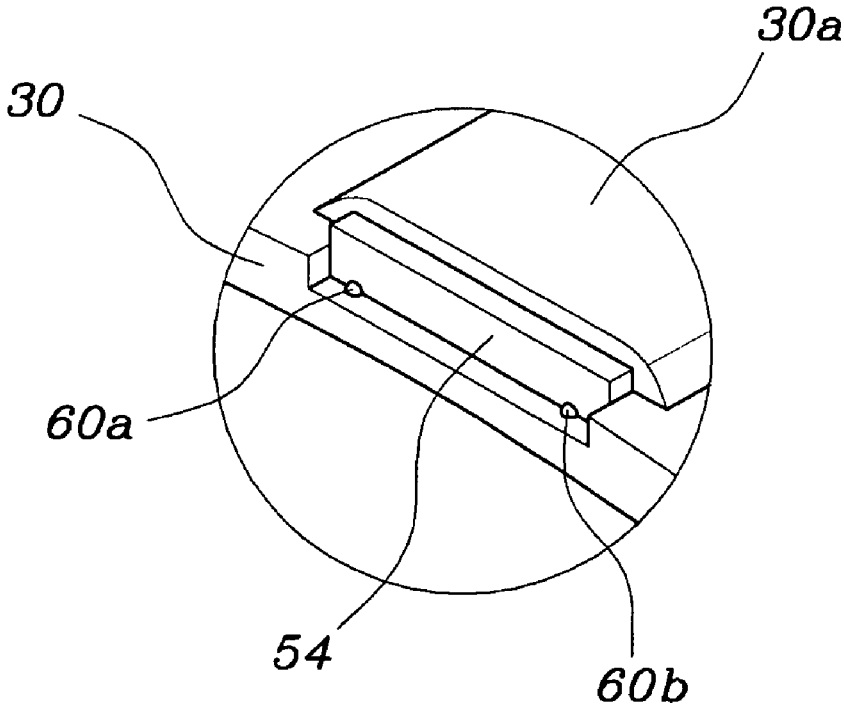
Figure 5C:
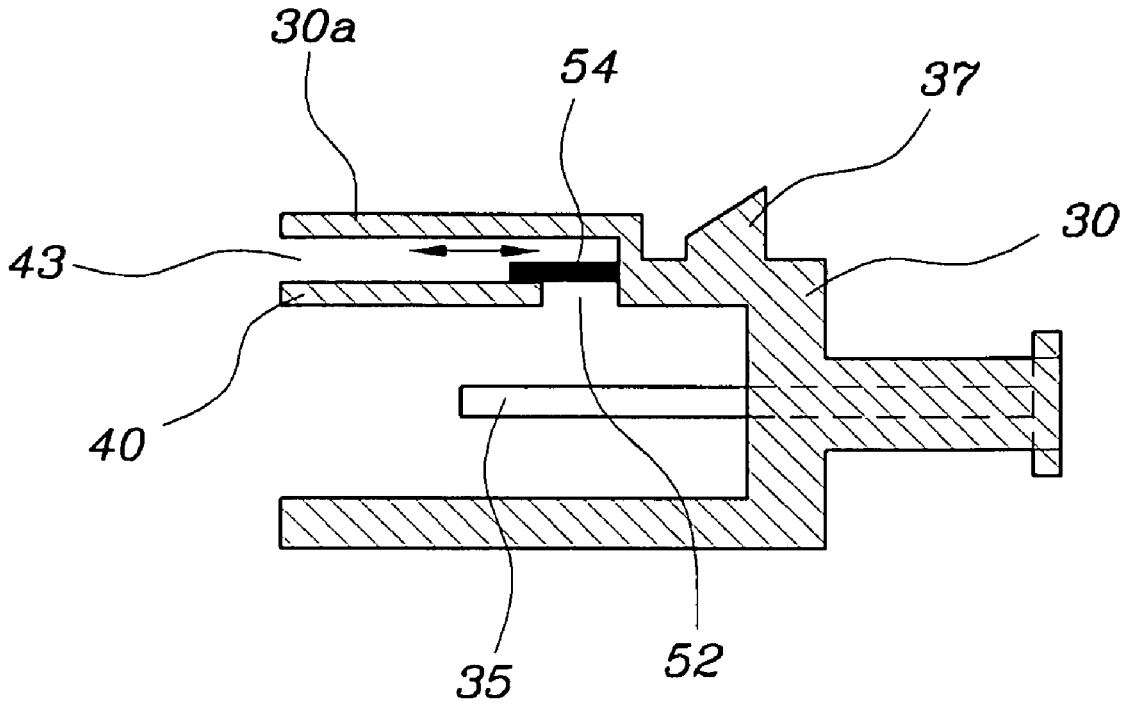

In the air discharge part 50, as shown in FIGS. 4A, 4B and 4C, the female connector member 10 has a structure in which a push bar 16 is formed above the female terminals 5 to push the slider 54 when the female and male connector members 10 and 30 are coupled to each other. Further, as shown in FIGS. 5A, 5B and 5C, the male connector member 30 has a structure in which a slide guide 40 is formed above the male terminals 35 to allow the slider 54 to be moved rearward thereon.

Thus, in the air discharge part 50, when the female connector member 10 and the male connector member 30 are coupled to each other, the push bar 16 is introduced into the male connector member 30, moves on the slide guide 40, and pushes the slider 54 rearward.

The air passage hole 52 is defined through the rear end of the slide guide 40. As the slider 54 is pushed rearward by the push bar 16, the slider 54 is moved over the air passage hole 52. Therefore, if the slider 54 is moved rearward from the state in which it is positioned on the front portion of the slide guide 40, the slider 54 closes the air passage hole 52 of the slide guide 40.

Figure 6:
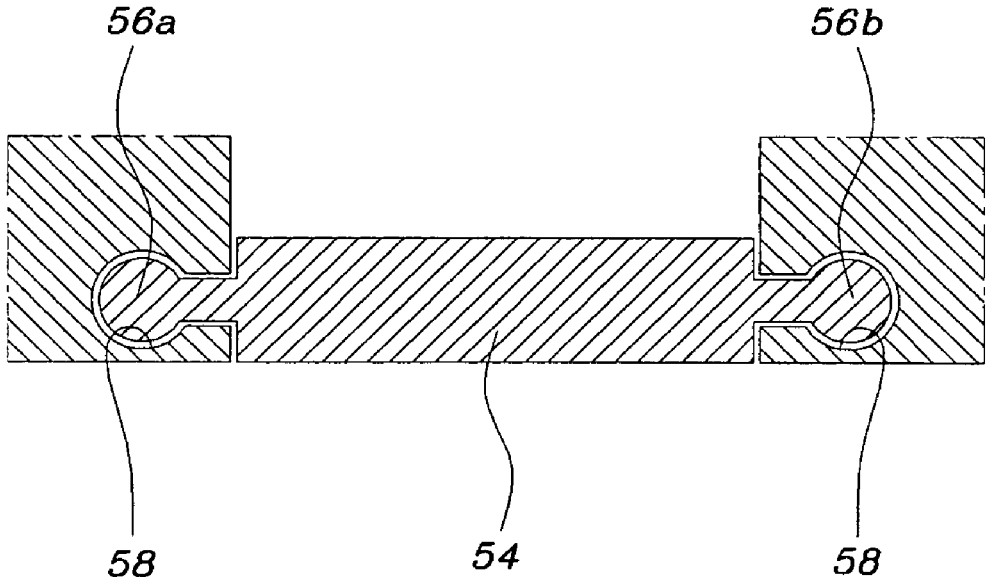
FIG. 6 is an assembled cross-sectional view independently illustrating the slider of the waterproof connector according to an embodiment of the present invention.

Referring to FIG. 6, the slider 54 includes slide projections 56*a* and 56*b* formed on both side surfaces thereof. The slide projections 56*a* and 56*b* are fitted into slide grooves 58 which are defined in the male connector member 30 to be linearly moved therein. Due to this structure, when the slider 54 is pushed rearward by the push bar 16, the slider 54 is prevented from deviating leftward, rightward, upward or downward, and instead, is linearly moved.

The slide guide 40 is formed, on the front end thereof, with stoppers 60*a* and 60*b* for preventing the slider 54 from being released to the outside. That is to say, as shown in FIG. 5B, since a plurality of stoppers 60*a* and 60*b* are formed to project out of the upper surface of the slide guide 40, the slider 54 is prevented from being released from a guide path 43 which is defined between the slide guide 40 and the upper end portion 30*a* of the male connector member 30.

The female connector member 10 includes a primary waterproof seal 70 therein. As shown in FIG. 3B, the primary waterproof seal 70 is squeezed between the slide guide 40 and the lower end portion of the male connector member 30 when the female and male connector members 10 and 30 are coupled to each other, to prevent the leakage of moisture from the outside.

Also, the female connector member 10 has a secondary waterproof seal 72 which is squeezed by the edge of the upper end portion 30*a* of the male connector member 30 to prevent the leakage of moisture from outside, as shown in FIG. 3B.

When the female and male connector members 10 and 30 are coupled to each other, the primary and second waterproof seals 70 and 72 completely prevent the leakage of moisture from outside and function to securely hold them to each other.

A process for assembling a waterproof connector according to a preferred embodiment of the present invention is described below.

In the waterproof connector 1 according to the present invention, constructed as mentioned above, before the female and male connector members 10 and 30 are coupled to each other, the slider 54 of the male connector member 30 is positioned forward on the slide guide 40, and the air passage hole 52, defined through the rear end of the slide guide 40, is open.

In this state, as the male connector member 30 is inserted into the female connector member 10, the slide guide 40 is moved under the push bar 16 of the female connector member 10, by which the push bar 16 pushes and moves the slider 54 rearward.

In this course, as can be seen from FIG. 3A, the air present in the female and male connector members 10 and 30 is discharged through the air passage hole 52 defined in the male connector member 30, through the guide path 43 which is defined between the slide guide 40 and the upper end portion 30*a* of the male connector member 30, and through the space between the upper end portion 10*a* of the female connector member 10 and the upper end portion 30*a* of the male connector member 30. Due to this structure, the air present in the female and male connector members 10 and 30 can be effectively discharged to the outside, and is prevented from being compressed in the female and male connector members 10 and 30.

Therefore, when the female and male connector members 10 and 30 are coupled to each other, since the force required to couple them to each other is not high, they can be easily coupled to each other, and productivity in the assembly thereof can be significantly improved.

Further, in the present invention, as can be readily seen from FIG. 3B, when the female and male connector members 10 and 30 are completely coupled to each other, the leakage of moisture from the outside is effectively prevented. That is to say, when the female and male connector members 10 and 30 are coupled to each other, the primary waterproof seal 70 is squeezed between the slide guide 40 and the lower end portion of the male connector member 30 to completely prevent the leakage of moisture from the outside.

Moreover, when the female and male connector members 10 and 30 are coupled to each other, the secondary waterproof seal 72, which is arranged in the female connector member 10, is squeezed by the edge of the upper end portion 30*a* of the male connector member 30 to completely prevent the leakage of moisture from the outside toward the air passage hole 52.

Therefore, the primary and secondary waterproof seals 70 and 72, which are arranged in the female connector member 10, can completely prevent the leakage of moisture from the outside when the female and male connector members 10 and 30 are coupled to each other. Also, due to the fact that the coupling projection 37 of the male connector member 30 is fitted into the coupling hole 12 of the female connector member 10 in order to couple the female and male connector members 10 and 30 to each other, the female and male connector members 10 and 30 can be securely held with respect to each other.

As described above, when the female and male connector members 10 and 30 are coupled to each other, since the inside air is discharged to the outside through the air passage hole 52, the assembly of the waterproof connector 1 according to the present invention can be easily conducted with a reduced force. Hence, the productivity in assembling the female and male connector members 10 and 30 can be increased.

Furthermore, in the present invention, after the female and male connector members 10 and 30 are coupled to each other, since the spaces inside the female and male connector members 10 and 30 can be hermetically sealed by the primary and secondary waterproof seals 70 and 72, the leakage of moisture from the outside can be completely prevented.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A waterproof connector, comprising:

a female connector member including a plurality of female terminals formed therein;

a male connector member including a plurality of male terminals formed therein to correspond to respective female terminals of the female connector member; and an air discharge part having a structure in which an air passage hole for discharging inside air to the outside when the female and male connector members are assembled to each other and a slider for closing the air passage hole after air is discharged are formed in the male connector member, wherein, in the air discharge part, a push bar is formed above the female terminals of the female connector member to push the slider when the female and male connector members are coupled to each other, and a slide guide is formed above the male terminals of the male connector member to allow the slider to be moved rearward thereon.

2. The waterproof connector according to claim 1, wherein the air passage hole is defined through a rear end of the slide guide, and as the slider is moved rearward from a state in which it is positioned on a front portion of the slide guide, the slider closes the air passage hole.

3. The waterproof connector according to claim 2, wherein the slider is provided with slide projections formed on both side surfaces thereof, the male connector member is provided with slide grooves, and the slide projections are fitted into the slide grooves so that the slider can be linearly moved therein.

4. The waterproof connector according to claim 2, wherein the slide guide is provided, on a front end thereof, with stoppers for preventing the slider from being released to the outside.

5. The waterproof connector according to claim 1, wherein the female connector member includes a primary waterproof seal which is squeezed between the slide guide and a lower end portion of the male connector member when the female and male connector members are coupled to each other so as to prevent the leakage of moisture from the outside.

6. The waterproof connector according to claim 5, wherein the female connector member includes a secondary waterproof seal which is squeezed by an edge of an upper end portion of the male connector member when the female and male connector members are coupled to each other so as to prevent leakage of moisture from the outside.

* * * * *